US008348782B2

(12) United States Patent
Park et al.

(10) Patent No.: US 8,348,782 B2
(45) Date of Patent: Jan. 8, 2013

(54) GOLF CLUB HEAD

(75) Inventors: Sharon J. Park, Irvine, CA (US); Kevin R. Tassistro, Torrance, CA (US); Robert Van Der Heyden, Tustin, CA (US)

(73) Assignee: SRI Sports Limited, Kobe (JP)

( * ) Notice: Subject to any disclaimer, the term of this patent is extended or adjusted under 35 U.S.C. 154(b) by 96 days.

(21) Appl. No.: 12/436,998

(22) Filed: May 7, 2009

(65) Prior Publication Data

US 2009/0280923 A1 Nov. 12, 2009

(51) Int. Cl.
*A63B 53/04* (2006.01)

(52) U.S. Cl. ..... 473/291; 473/349

(58) Field of Classification Search ..... 473/291
See application file for complete search history.

(56) References Cited

U.S. PATENT DOCUMENTS

| | | | | |
|---|---|---|---|---|
| 4,792,139 | A | 12/1988 | Nagasaki et al. | 273/167 H |
| 5,800,282 | A | 9/1998 | Hutin et al. | 473/291 |
| 6,435,977 | B1 | 8/2002 | Helmstetter et al. | 473/290 |
| 6,506,127 | B2 | 1/2003 | Helmstetter et al. | 473/290 |
| 6,592,469 | B2 | 7/2003 | Gilbert | 473/350 |
| D487,127 | S | 2/2004 | Madore | D21/759 |
| 6,872,153 | B2 | 3/2005 | Gilbert et al. | 473/332 |
| 6,875,124 | B2 * | 4/2005 | Gilbert et al. | 473/290 |
| 6,921,344 | B2 | 7/2005 | Gilbert et al. | 473/334 |
| 6,964,620 | B2 | 11/2005 | Gilbert et al. | 473/332 |
| 6,976,924 | B2 * | 12/2005 | Gilbert et al. | 473/332 |
| 7,004,848 | B2 | 2/2006 | Konow | 473/223 |
| 7,004,853 | B2 | 2/2006 | Deshmukh | 473/332 |
| 7,014,571 | B2 | 3/2006 | Deshmukh | 473/342 |
| 7,083,525 | B2 | 8/2006 | Pond et al. | 473/251 |
| 7,186,188 | B2 | 3/2007 | Gilbert et al. | 473/290 |
| 7,192,361 | B2 | 3/2007 | Gilbert et al. | 473/290 |
| 7,192,362 | B2 | 3/2007 | Gilbert et al. | 473/291 |
| 7,232,377 | B2 | 6/2007 | Gilbert et al. | 473/290 |
| 7,273,418 | B2 | 9/2007 | Gilbert et al. | 473/290 |
| 7,371,190 | B2 | 5/2008 | Gilbert et al. | 473/332 |
| 7,524,250 | B2 * | 4/2009 | Soracco et al. | 473/349 |
| 2005/0148407 | A1 | 7/2005 | Gilbert et al. | 473/346 |
| 2006/0030425 | A1 | 2/2006 | Sukman | 473/345 |
| 2006/0166758 | A1 | 7/2006 | Roberts et al. | 473/349 |
| 2006/0234805 | A1 | 10/2006 | Gilbert et al. | 473/290 |
| 2006/0258480 | A1 | 11/2006 | Hou et al. | 473/332 |
| 2007/0004530 | A1 * | 1/2007 | Galloway et al. | 473/334 |
| 2007/0191134 | A1 | 8/2007 | Gilbert et al. | 473/330 |
| 2008/0026866 | A1 | 1/2008 | Gilbert et al. | 473/290 |
| 2008/0058119 | A1 | 3/2008 | Soracco et al. | 473/350 |
| 2008/0058120 | A1 | 3/2008 | Roberts et al. | 473/350 |

* cited by examiner

*Primary Examiner* — Michael Dennis
(74) *Attorney, Agent, or Firm* — Steptoe & Johnson LLP

(57) ABSTRACT

At least two golf clubs of a set, according to one or more aspects of the present invention, may include a strike face and a perimeter weighting element disposed behind the strike face. The perimeter weighting element may include an inner peripheral wall having a sole surface, a top surface, a heel surface, and a toe surface. A cavity, having a base surface, may be delimited by the inner peripheral wall and may include an insert disposed therein. The insert may comprise a primary element passively flexurally associated with one or more secondary elements and may be substantially identical for each head within the set. The primary element may be associated with the base surface and the at least one secondary element may be associated with at least one of the sole surface, the top surface, the toe surface, and the heel surface.

23 Claims, 12 Drawing Sheets

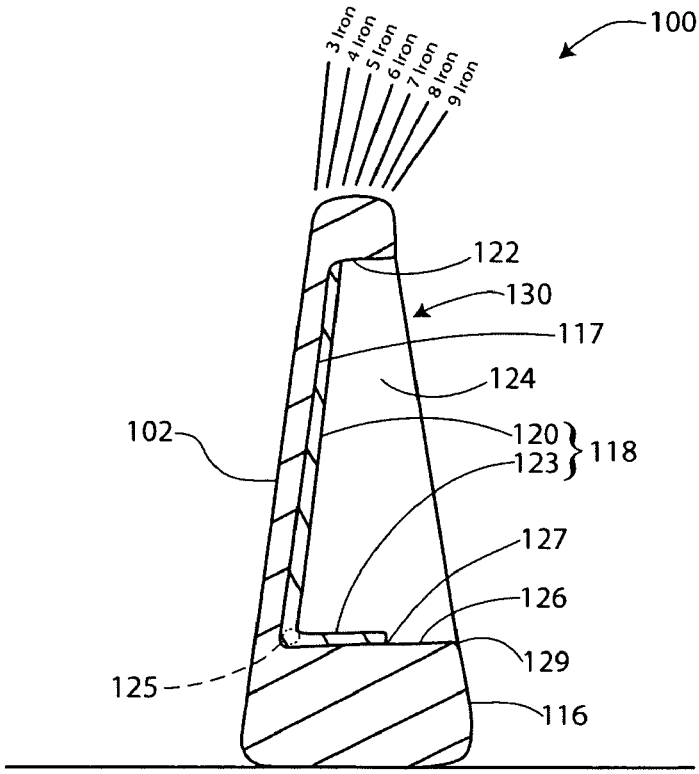
FIG. 1E1
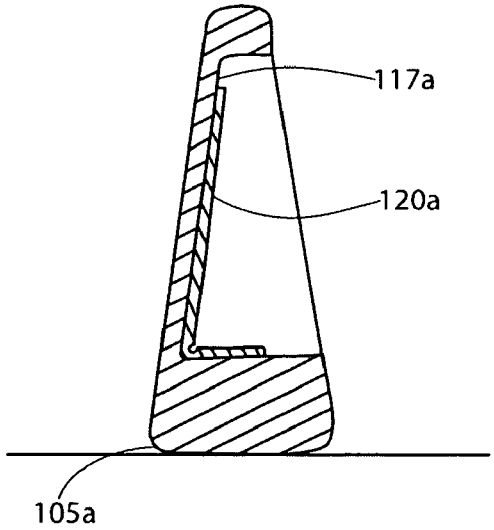
FIG. 1E2

GOLF CLUB HEAD

COPYRIGHT AUTHORIZATION

The disclosure below may be subject to copyright protection. The copyright owner has no objection to the facsimile reproduction by anyone of the documents containing this disclosure, as they appear in the Patent and Trademark Office records, but otherwise reserves all applicable copyrights.

BACKGROUND

Iron-type golf club heads may generally be classified into "blade" and "perimeter-weighted" categories. Perimeter-weighted iron-type club heads may have a substantial concentration of mass distributed behind the striking face in the form of at least one peripheral wall, sometimes called the perimeter-weighting element. A perimeter-weighted iron-type golf club may also be referred to as a "cavity-back" iron because the perimeter-weighting element generally delimits a cavity in the rear portion of the club head opposite the striking face.

To enhance the tactile feedback communicated to the player at ball impact, both the rear cavity and at least a portion of the perimeter-weighting element of each cavity-back club head in a set may be provided with one or more vibration-damping members to reduce undesirable dynamic excitation, synonymous with mishit shots. Those skilled in the art will appreciate that the customary progression of club head specifications throughout an iron set may require that the geometry of at least one of the vibration-damping members also transition throughout the set in a complementary manner. Accordingly, at least one unique vibration-damping member for each club head of the set may be required, thus resulting in greater production costs and reduced manufacturing efficiency. Conversely, each club head of a perimeter-weighted iron set may include a mounting "cradle" for receiving the vibration-damping member. The "cradle" in each iron may be configured and oriented to allow the use of identical vibration-damping members throughout the set. However, this geometric constraint may unfavorably affect mass properties of one or more clubs heads in the set.

SUMMARY

The present invention, in one or more aspects thereof, may comprise a golf club head having improved tactile feedback on mishit shots. Additionally, the present invention may include a set of golf clubs having an advantageous construction that promotes enhanced manufacturing efficiency, reduced production costs, and favorable mass distribution.

In one example, at least two clubs of a set, according to one or more aspects of the present invention, may include a strike face and a perimeter-weighting element disposed behind the strike face. The perimeter weighting element may include an inner peripheral wall having a bottom surface, a top surface, a heel surface, and a toe surface. A cavity, having a base surface, may be delimited by the inner peripheral wall and may include an insert, disposed therein. The insert may comprise a primary element and at least one secondary element wherein the primary element is passively flexurally associated with one or more secondary elements and may be substantially identical for at least two heads within the set. The primary element may be associated with the base surface, and the at least one secondary element may be associated with at least one of the bottom surface, the top surface, the toe surface, and the heel surface.

In another example, a golf club head, according to one or more aspects of the present invention, may include a strike face and a perimeter-weighting element disposed behind the strike face. The perimeter weighting element may include an inner peripheral wall having a bottom surface, a top surface, a heel surface, and a toe surface. A cavity, having a base surface, may be delimited by the inner peripheral wall and may include an insert disposed therein. The insert may comprise a primary element and at least one secondary element wherein the primary element is passively flexurally associated with one or more secondary elements. The primary element may be associated with the base surface and the at least one secondary element may be associated with at least one of the bottom surface, the top surface, the toe surface, and the heel surface.

These and other features and advantages of the golf club head according to the invention in its various aspects, as provided by one or more of the examples described in detail below, will become apparent after consideration of the ensuing description, the accompanying drawings, and the appended claims. The accompanying drawings are for illustrative purposes only and are not intended to limit the scope of the present invention.

BRIEF DESCRIPTION OF THE DRAWINGS

Exemplary implementations of the present invention will now be described with reference to the accompanying drawings, wherein:

FIG. 1E1 is a schematic view of a correlated set of iron-type golf club heads according to one or more aspects of the present invention.

FIG. 1E2 is a schematic view of an exemplary golf club head according to one or more aspects of the present invention.

FIG. 2 is a toe-side sectional view of an exemplary golf club head according to one or more aspects of the present invention.

DESCRIPTION

Figure 1A:
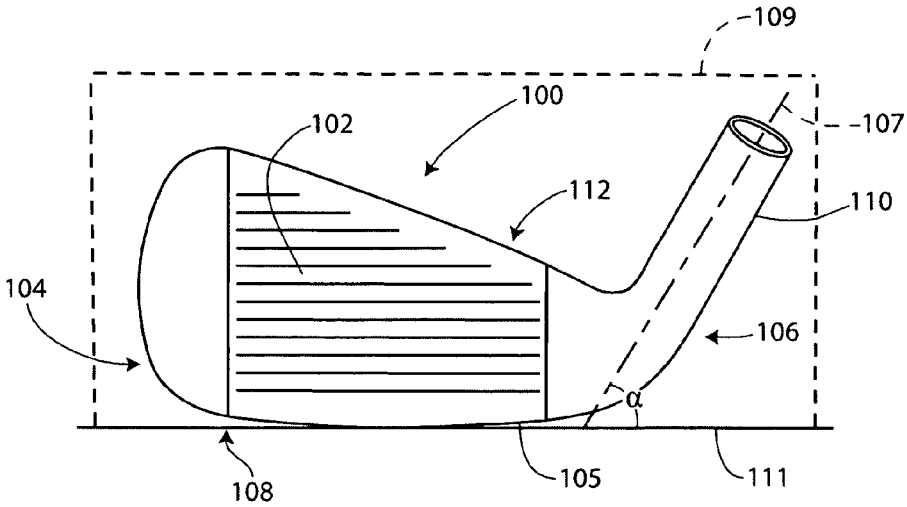
FIG. 1A is a front elevational view of an exemplary golf club head according to one or more aspects of the present invention.

Referring to FIG. 1A, a golf club head 100, according to one or more aspects of the present invention, may generally comprise a toe portion 104, a heel portion 106, a sole portion 108, a top portion 112, a strike face 102, having a leading edge 105, and a hosel 110 for receiving a shaft (not shown). The hosel 110 has a hosel centerline 107. The strike face 102 may be integral with the club head, or alternatively, may be joined thereto, e.g., by welding, brazing, adhesive bonding, or mechanical interlocking.

Unless otherwise indicated, all parameters described below are specified with the club head 100 in a "reference position." The "reference position", as used herein, denotes a position of the club head 100 where the hosel centerline 107 is in an imaginary vertical plane 109 and is oriented at an actual lie angle $\alpha$ with respect to a ground plane 111. The plane 109 is oriented generally parallel to the leading edge 105.

Figure 1B:
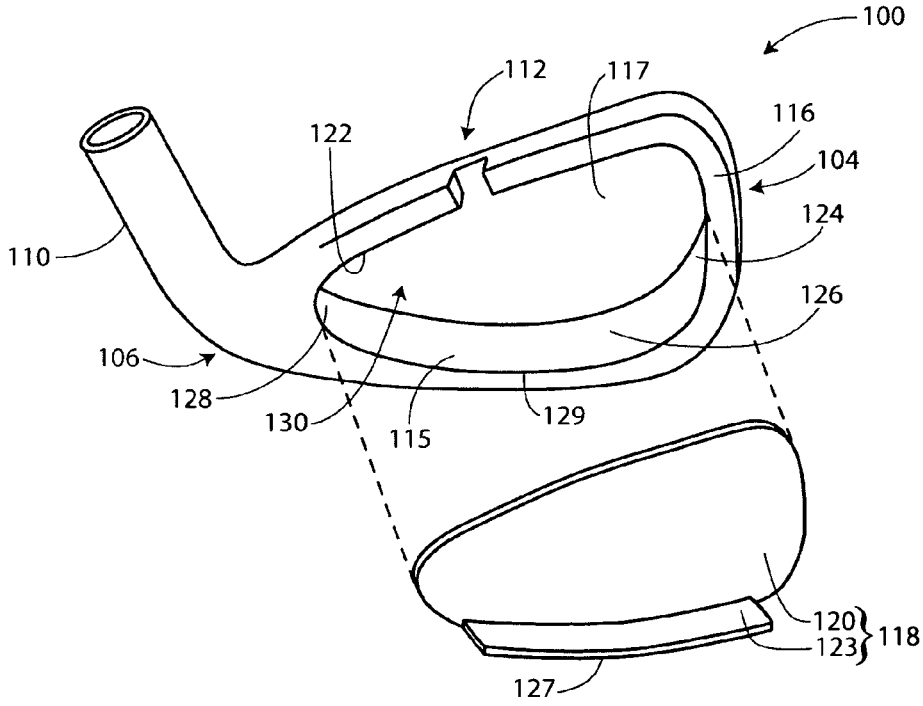
FIG. 1B is an exploded rear perspective view of the golf club head of FIG. 1A.

As illustrated in FIG. 1B, the golf club head 100 may further include a rear cavity 130, which is delimited by a base surface 117, surrounded, at least in part, by a perimeter-weighting element 116, having an inner peripheral wall 115. The inner peripheral wall 115 may include a toe surface 124, a heel surface 128, a top surface 122, and a bottom surface 126, having a trailing edge 129. Those skilled in the art will appreciate that the trailing edge 129 may be a "hard" edge, defined by an abrupt transition between surfaces 126 and 116, or a "soft" edge, defined by a gradual transition between the aforementioned surfaces. In one or more aspects of the present invention, portions of the perimeter-weighting element 116 may be replaced with light-weight materials, e.g., low-density composites and/or polymers, to improve the mass properties of the club head, or may be eschewed altogether. A first insert 118 may be disposed in the cavity 130 and may include a primary element 120 and at least one secondary element 123, having a trailing edge 127, proximate the inner peripheral wall 115.

The first insert, e.g., the insert 118, according to one or more aspects of the present invention, may comprise a free-layer damper and may be formed from a highly damped, dynamically stiff material having a Shore hardness between about 30A and about 100A, preferably between about 70A and about 90A, and more preferably between about 75A and about 85A, to deliver beneficial damping characteristics. Damping efficiency of the insert 118 may be changed by adjusting the thickness thereof. In one example, the insert 118 may be formed from a viscoelastic material, capable of storing strain energy when deformed and dissipating a portion of this energy through hysteresis. Alternatively, the insert 118 may be formed from dissimilar materials. For example, the insert 118 may include an at least partially metallic primary element and at least one non-metallic secondary element. Examples of materials suitable for fabricating the insert 118 may include aluminum, titanium, stainless steel, polyurethane, silicone, Nylon, polypropylene (PP), polyethylene (PE), thermoplastic rubber (TPR), thermoplastic vulcanizate (TPV), thermoplastic polyurethane (TPU), thermoplastic elastomers (TPE), and/or natural rubber.

Figure 1C:
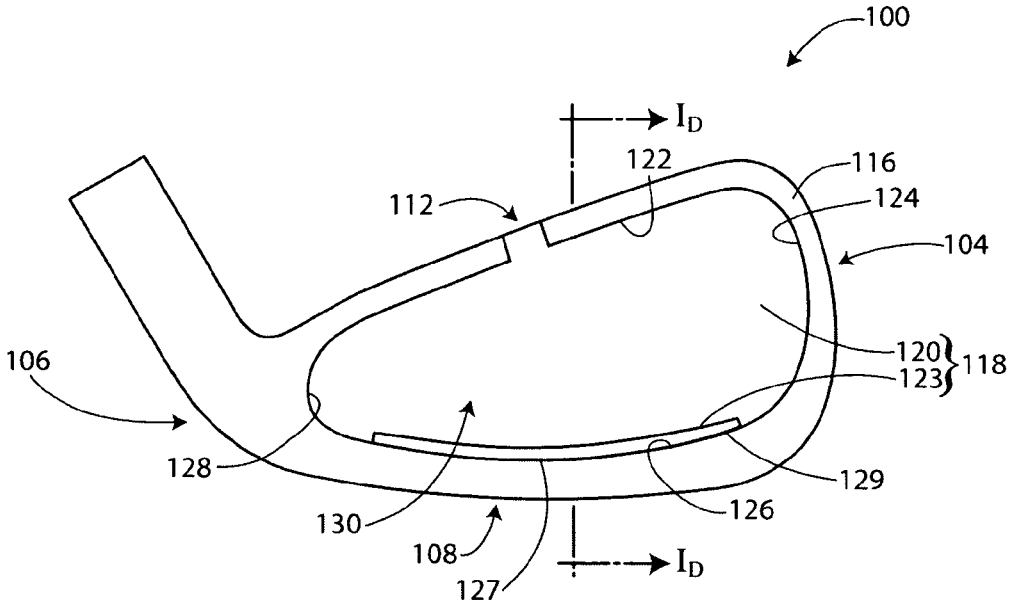
FIG. 1C is a rear elevational view of the golf club head of FIG. 1A.
Figure 1D:
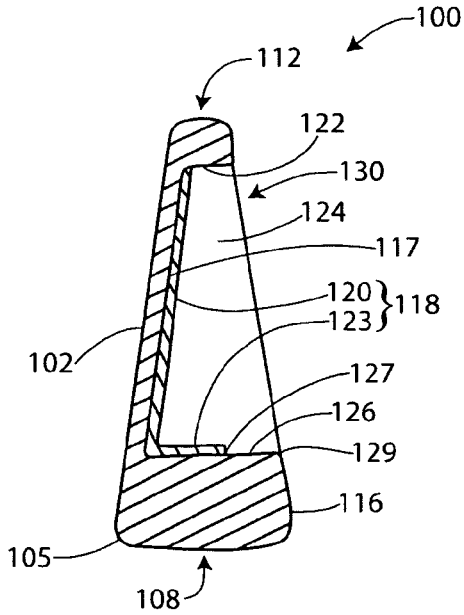
FIG. 1D is a cross-sectional view taken along the lines $I_D$-$I_D$ of FIG. 1C.

As illustrated in FIGS. 1C and 1D, the primary element 120 and the at least one secondary element 123 may be attached to the base surface 117 and the bottom surface 126, respectively, via, e.g., a bonding agent.

Referring to FIG. 1E1, a correlated set of iron-type club heads, according to one or more aspects of the present invention, includes the club head 100. To reduce labor and tooling costs, at least two club heads of the set may include an insert substantially identical to the insert 118. In any of the club heads containing the aforementioned insert, for any given imaginary vertical plane that is generally perpendicular to the leading edge 105 of the strike face 102 and that intersects the trailing edge 127 of the secondary element 123 at a first point and the trailing edge 129 of the bottom surface 126 at a second point, the first point is disposed closer to the leading edge 105 of the strike face 102 then the second point or is coincident with the second point. Since at least two club heads in the set utilize substantially identical inserts, in some examples of the invention, the base surfaces of at least two club heads in the set may be substantially congruent to accommodate the primary element 120 of the insert 118. As shown in FIG. 1E2, in other aspects of the invention, the perimetric area of the base surface, e.g., a base surface 117*a*, may exceed the perimetric area of the primary element, e.g., a primary element 120*a*. Perimetric area, as used herein, denotes the maximum area for an object with a given perimeter.

Figure 1F:
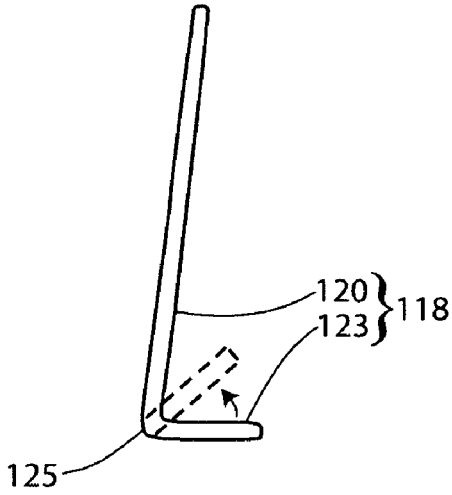
FIG. 1F is a schematic view of an exemplary insert according to one or more aspects of the present invention.
Figure 2:
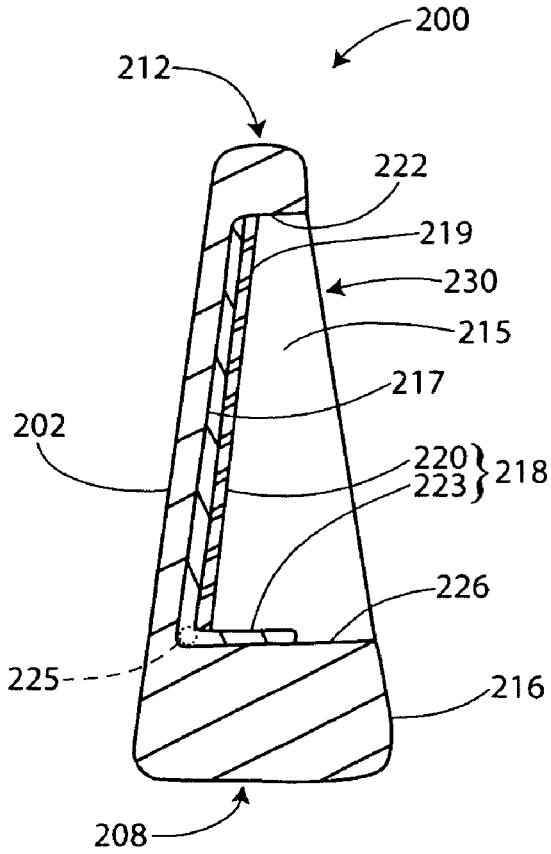

As shown in FIG. 1F, to accommodate variations in clubhead geometry throughout the set, the primary element of the insert 118, e.g., the primary element 120, may be associated with the secondary element, e.g., the secondary element 123, via a passive flexural coupling 125 without compromising the fit of the insert in the rear cavities of at least two club heads of a set. For example, referring again to FIG. 1E1, the insert 118 may flex about the coupling 125 to allow for loft progression throughout the set. The passive flexural coupling, e.g., the coupling 125, as used herein, denotes a flexible junction that exerts a negligible biasing force on the insert elements, as they are pivoted relative to each other. The negligible biasing force is a force exerted by the junction biasing the first and the second elements of the insert relative to each other, such that the insert readily conforms to the contours of the cavities of at least two irons in a set and may be inserted in such cavities with light hand pressure. Those skilled in the art will appreciate that the passive flexural coupling, described above, may comprise, for example, a region of reduced thickness and/or stiffness or another type of mechanical joint.

In another example, shown in FIG. 2, a golf club head 200, according to one or more aspects of the present invention, may include a sole portion 208, a top portion 212, and a strike face 202. A perimeter-weighting element 216 may be located behind the strike face 202 and may include an inner peripheral wall 215 that defines a cavity 230, having a base surface 217. The inner peripheral wall 215 may include a top surface 222 and a bottom surface 226. A first insert 218 may be disposed in the cavity 230 and may include a primary element 220, associated with the base surface 217, and at least one secondary element 223, associated with the sole surface 226. A second insert 219 may be attached to the primary element 220 of the first insert 218, e.g., via a bonding agent, or may be co-molded therewith. The insert 219 may include an elastic material, such as thermoplastic polyurethane (TPU), or a rigid material, such as aluminum or a polymer, having a comparatively high stiffness. The second insert 219 may include indicia, such as a logo. In one example of the invention, the first and second inserts constitute a constrained-layer damping system wherein the first insert, made of a viscoelastic material, is sandwiched between the base layer of the club head and the second insert 219. When the system flexes during vibration, shear strains develop in the first insert 218, whereby energy is lost through shear deformation of the insert, thus suppressing undesirable resonant motion. To accommodate variations in club-head geometry throughout an iron set, the primary element, e.g., the primary element 220, may be associated with the secondary element, e.g., the secondary element 223, via a passive flexural coupling 225 without compromising the fit of the insert within the rear cavities of at least two club heads within the set.

Figure 3A:
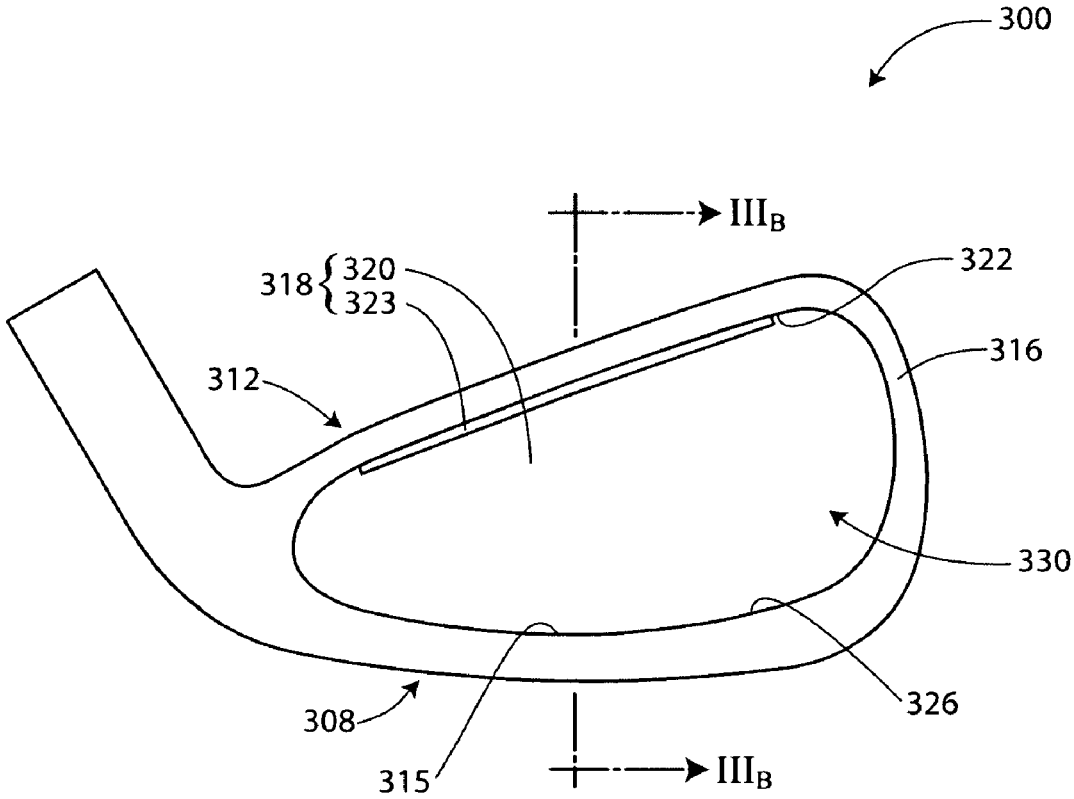
FIG. 3A is a rear elevational view of an exemplary golf club head according to one or more aspects of the present invention.
Figure 3B:
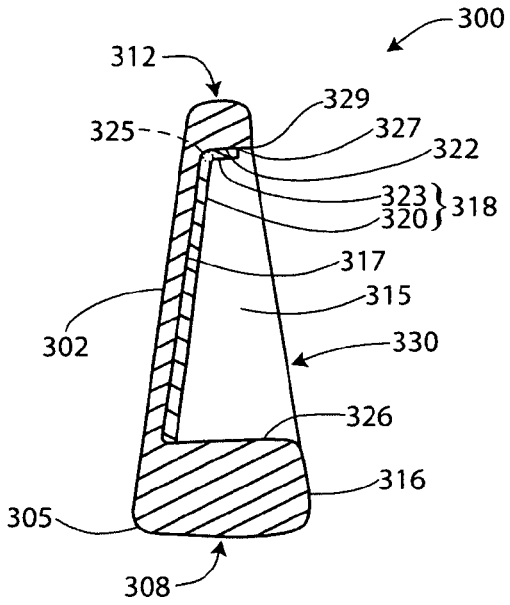
FIG. 3B is a cross-sectional view taken along the lines $III_B$-$III_B$ of FIG. 3A.

Referring to FIGS. 3A and 3B, a golf club head 300, according to one or more aspects of the present invention, may include a sole portion 308, a top portion 312, and a strike face 302 (FIG. 3B) having a leading edge 305. A perimeter-weighting element 316 may be located behind the strike face 302 and may include an inner peripheral wall 315 that defines a cavity 330, having a base surface 317. The inner peripheral wall 315 may include a bottom surface 326 and a top surface 322, having a trailing edge 329. An insert 318 may be disposed in the cavity 330 and may include a primary element 320, associated with the base surface 317, and at least one secondary element 323, associated with the top surface 326. The secondary element 323 may have a trailing edge 327 proximate the inner peripheral wall 315. To accommodate variations in club-head geometry throughout an iron set, the primary element, e.g., the primary element 320, may be associated with the secondary element, e.g., the secondary element 323, via a passive flexural coupling 325 without compromising the fit of inserts, such as the insert 318, within each of the rear cavities of at least two club heads within the set. In any of the club heads containing the aforementioned insert, for any given imaginary vertical plane that is generally perpendicular to the leading edge 305 of the strike face 302 and that intersects the trailing edge 327 of the secondary element 323 at a first point and the trailing edge 329 of the top surface 322 at a second point, the first point is disposed closer to the strike face 302 then the second point or is coincident with the second point.

Figure 4A:
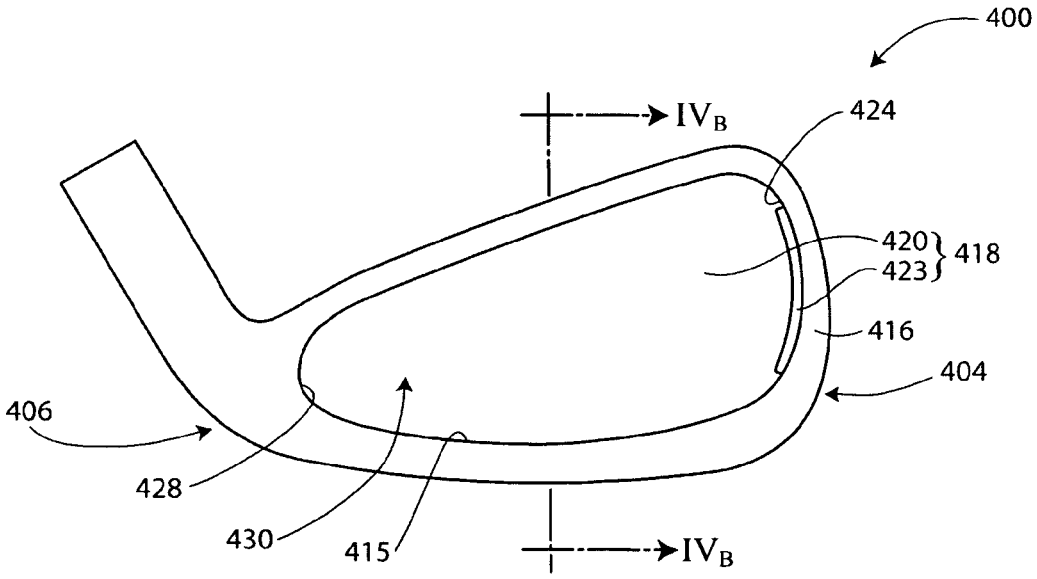
FIG. 4A is a rear elevational view of an exemplary golf club head according to one or more aspects of the present invention.
Figure 4B:
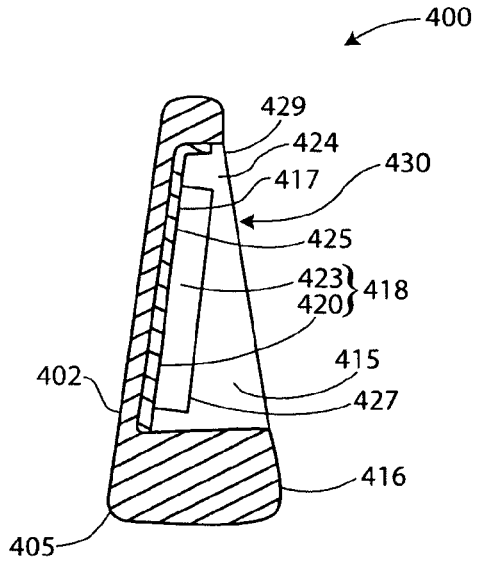
FIG. 4B is a cross-sectional view taken along the lines $IV_B$-$IV_B$ of FIG. 4A.

As shown in FIGS. 4A and 4B, a golf club head 400, according to one or more aspects of the present invention, may include a toe portion 404, a heel portion 406, and a strike face 402 (FIG. 4B) having a leading edge 405. A perimeter-weighting element 416 may be located behind the strike face 402 and may include an inner peripheral wall 415 that defines a cavity 430 having a base surface 417. The inner peripheral wall 415 may include a heel surface 428 and a toe surface 424, having a trailing edge 429. An insert 418 may be disposed in the cavity 430 and may include a primary element 420, associated with the base surface 417, and at least one secondary element 423, associated with the toe surface 424. The secondary element may have a trailing edge 427, proximate the inner peripheral wall 415. To accommodate variations in club-head geometry throughout an iron set, the primary element, e.g., the primary element 420, may be associated with the secondary element, e.g., the secondary element 423, via a passive flexural coupling 425 without compromising the fit of the insert within each of the rear cavities of at least two club heads within the set. In any of the clubs containing the aforementioned insert, for any given imaginary horizontal plane that intersects the trailing edge 427 of the secondary element 423 at a first point and the trailing edge 429 of the toe surface 424 at a second point, the first point is disposed closer to the strike face 402 then the second point or is coincident with the second point.

Figure 5A:
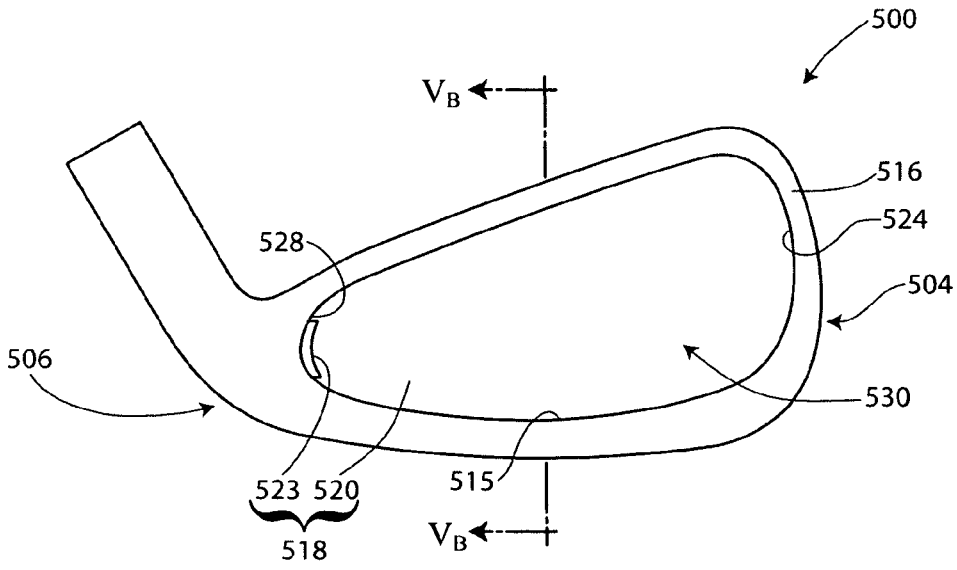
FIG. 5A is a rear elevational view of an exemplary golf club head according to one or more aspects of the present invention.
Figure 5B:
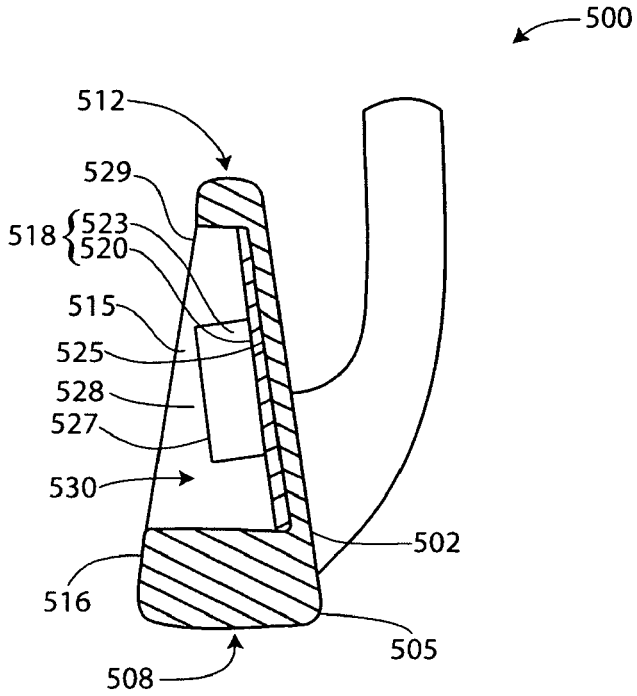
FIG. 5B is a cross-sectional view taken along the lines $V_B$-$V_B$ of FIG. 5A.

As illustrated in FIGS. 5A and 5B, a golf club head 500, according to one or more aspects of the present invention, may include a toe portion 504, a heel portion 506, and a strike face 502 (FIG. 5B). A perimeter-weighting element 516 may be located behind the strike face 502 and may include an inner peripheral wall 515 that defines a cavity 530 having a base surface 517. The inner peripheral wall 515 may include a toe surface 524 and a heel surface 528 having a trailing edge 529. An insert 518 may be disposed in the cavity 530 and may include a primary element 520, associated with the base surface 517, and at least one secondary element 523, associated with the heel surface 528. The secondary element 523 may have a trailing edge 527, proximate the inner peripheral wall 515. To accommodate variations in club-head geometry throughout an iron set, the primary element, e.g., the primary element 520, may be associated with the secondary element, e.g., the secondary element 523, via a passive flexural coupling 525 without compromising the fit of the insert within each of the rear cavities of at least two club heads within the set. In any of the clubs containing the aforementioned insert, for any given imaginary horizontal plane that intersects the trailing edge 527 of the secondary element 523 at a first point and the trailing edge 529 of the toe surface 524 at a second point, the first point is disposed closer to the strike face 502 then the second point or is coincident with the second point.

Figure 6A:
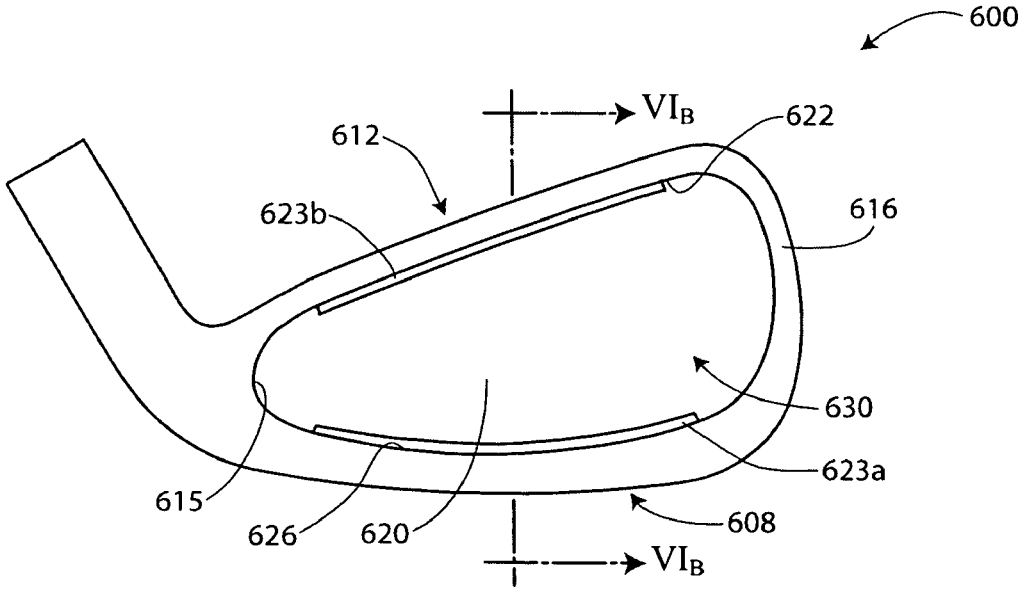
FIG. 6A is a rear elevational view of an exemplary golf club head according to one or more aspects of the present invention.
Figure 6B:
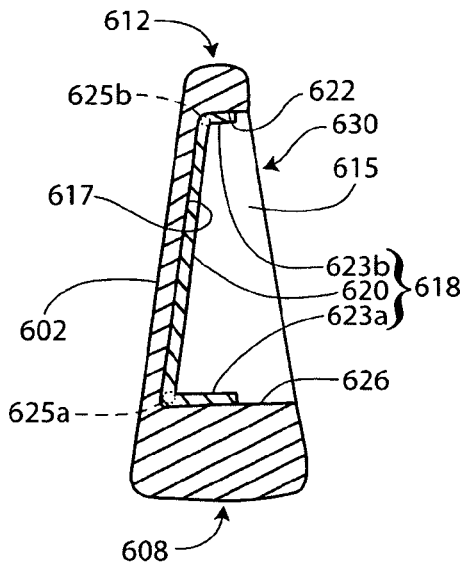
FIG. 6B is a cross-sectional view taken along the lines $VI_B$-$VI_B$ of FIG. 6A.

As shown in FIGS. 6A and 6B, a golf club head 600, according to one or more aspects of the present invention, may include a sole portion 608, a top portion 612, and a strike face 602 (FIG. 6B). A perimeter-weighting element 616 may be located behind the strike face 602 and may include an inner peripheral wall 615 that defines a cavity 630 having a base surface 617. The inner peripheral wall 615 may include a top surface 622 and a bottom surface 626. An insert 618 may be disposed in the cavity 630 and may include a primary element 620, associated with the base surface 617, a lower secondary element 623*a*, associated with the bottom surface 626, and an upper secondary element 623*b*, associated with the top surface 622. To accommodate variations in club-head geometry throughout an iron set, the primary element, e.g., the primary element 620, may be associated with the secondary elements, e.g., the secondary elements 623*a* and 623*b*, via passive flexural couplings 625*a* and 625*b*, respectively, without compromising the fit of the insert within each of the rear cavities of at least two club heads within the set.

Figure 7:
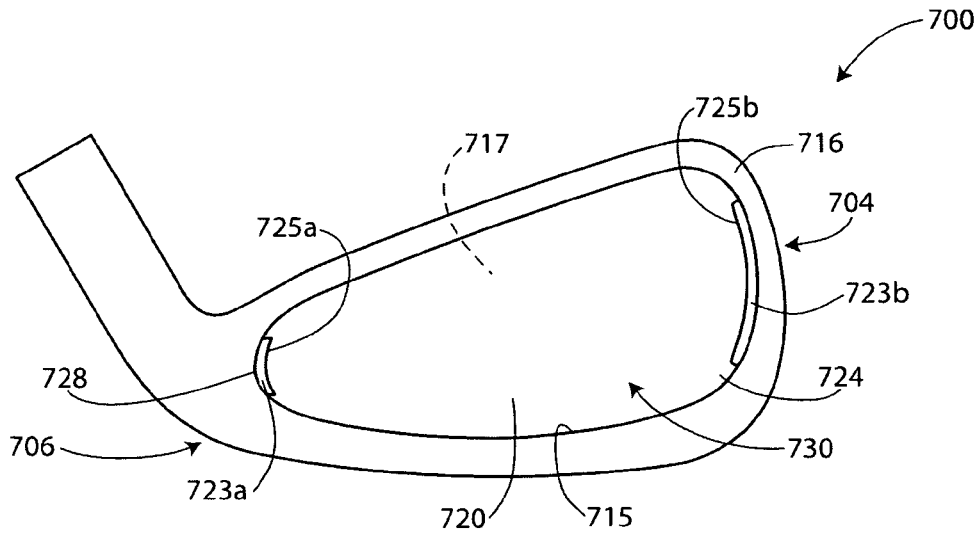
FIG. 7 is a rear elevational view of an exemplary golf club head according to one or more aspects of the present invention.

As shown in FIG. 7, a golf club head 700, according to one or more aspects of the present invention, may include a toe portion 704, a heel portion 706, and a strike face (not shown). A perimeter-weighting element 716 may be located behind the strike face and may include an inner peripheral wall 715 that defines a cavity 730 having a base surface 717. The inner peripheral wall 715 may include a toe surface 724 and a heel surface 728. An insert 718 may be disposed in the cavity 730 and may include a primary element 720, associated with the base surface 717, a heel secondary element 723*a*, associated with the heel surface 728, and a toe secondary element 723*b*, associated with the toe surface 724. To accommodate variations in club-head geometry throughout an iron set, the primary element, e.g., the primary element 720, may be associated with the secondary elements, e.g., the secondary elements 723*a* and 723*b*, via passive flexural couplings 725*a* and 725*b*, respectively, without compromising the fit of the insert within each of the rear cavities of at least two club heads within the set.

Figure 8A:
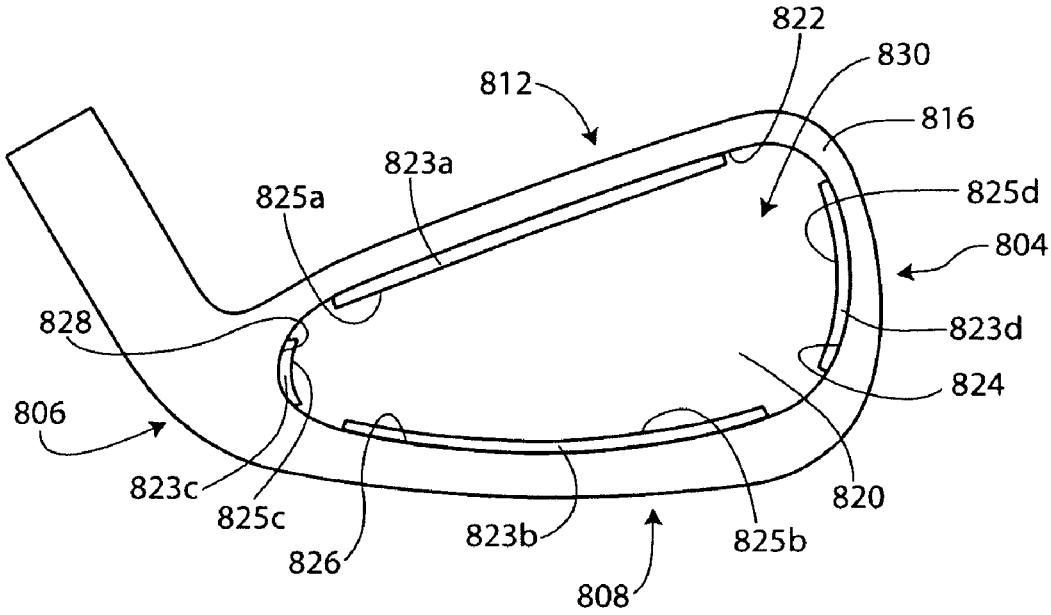
FIG. 8A is a rear elevational view of an exemplary golf club head according to one or more aspects of the present invention.

Referring to FIG. 8*a*, a golf club head 800, according to one or more aspects of the present invention, may include a toe portion 804, a heel portion 806, a sole portion 808, a top portion 812, and a strike face (not shown). A perimeter-weighting element 816 may be located behind the strike face and may include an inner peripheral wall 815 that defines a cavity 830 having a base surface 817. The inner peripheral wall 815 may include a toe surface 824, a heel surface 828, a top surface 822, and a bottom surface 826. An insert 818 may be disposed in the cavity 830 and may include a primary element 820, associated with the base surface 817, an upper secondary element 823*a*, associated with the top surface 822, a lower secondary element 823*b*, associated with the bottom surface 826, a heel secondary element 823*c*, associated with the heel surface 828, and a toe secondary element 823*d*, associated with the toe surface 824. To accommodate variations in club-head geometry throughout an iron set, the primary element, e.g., the primary element 820, may be associated with each of the secondary elements, e.g., the secondary elements 823 *a-d*, via passive flexural couplings 825 *a-d*, respectively, without compromising the fit of the insert within each of the rear cavities of at least two club heads within the set.

Figure 8B:
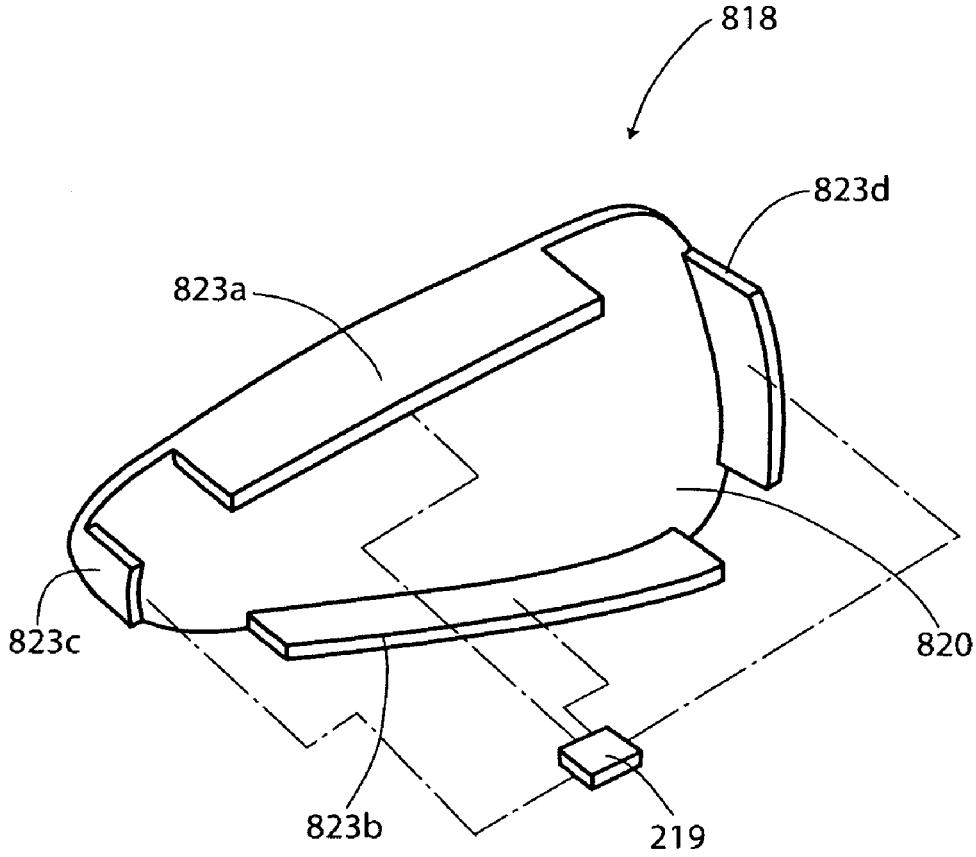
FIG. 8B is an exploded perspective view of an exemplary insert for a golf club head according to one or more aspects of the present invention.

FIG. 8*b* illustrates an exemplary first insert, e.g., the first insert 818, for a golf club head according to one or more aspects of the present invention. Those skilled in the art will appreciate that one or more of the secondary elements 823*a*-823*d* may be omitted from the first insert. Each secondary element of the first insert 818 may be co-molded with or attached to, e.g., via a bonding agent, a single second insert, e.g., the second insert 219. The insert 219 may be made of a rigid metallic and/or non-metallic material, such as carbon fiber, an elastic material, or a combination thereof. In one example of the invention, the first and the second inserts constitute a constrained-layer damping system wherein the first insert, made of a viscoelastic material, is sandwiched between the base layer of the club head and the second insert 219.

Figure 9:
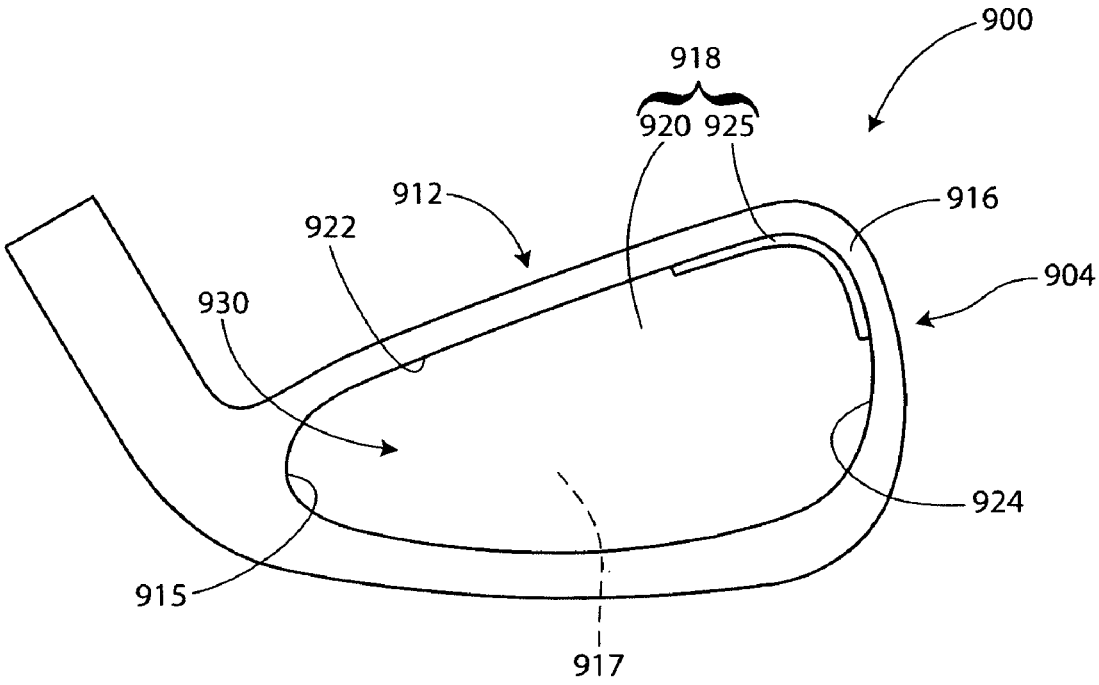
FIG. 9 is a rear elevational view of an exemplary golf club head according to one or more aspects of the present invention.

As shown in FIG. 9, a golf club head 900, according to one or more aspects of the present invention, may include a toe portion 904, a top portion 912, and a strike face (not shown). A perimeter-weighting element 916 may be located behind the strike face and may include an inner peripheral wall 915 that defines a cavity 930 having a base surface 917. The inner peripheral wall 915 may include a toe surface 924 and a top surface 922. An insert 918 may be disposed in the cavity 930 and may include a primary element 920, associated with the base surface 917, and a secondary element 923, associated with the toe surface 924 and the top surface 922. To accommodate variations in club-head geometry throughout an iron set, the primary element, e.g., the primary element 920, may be associated with the secondary element, e.g., the secondary element 923, via passive flexural coupling 925, without compromising the fit of the insert within each of the rear cavities of at least two club heads within the set.

In the foregoing specification, the invention has been described with reference to specific exemplary embodiments thereof. It will, however, be evident that various modifications and changes may be made thereto without departing from the broader spirit and scope of the invention as set forth in the appended claims. The specification and drawings are, accordingly, to be regarded in an illustrative rather than a restrictive sense.

What is claimed is:

1. A correlated set of golf club heads comprising:

a first golf club head having a first loft angle and a second golf club head having a second loft angle that is different from the first loft angle, each of the first golf club head and the second golf club head including:

a strike face;

a perimeter-weighting element behind the strike face, the perimeter weighting element including an inner peripheral wall having at least one of a top surface, a sole surface, a heel surface, and a toe surface, the inner peripheral wall delimiting a cavity having a base surface; and a first insert in the cavity the first insert comprising:

a primary element associated with the base surface, and at least one secondary element pivotably coupled with the primary element, by a passive flexural coupling configured to exert a negligible biasing force on the primary and secondary elements as the primary and secondary elements are pivoted relative to each other, the flexural coupling comprising a recessed region, and the at least one secondary element associated with at least one of the top surface, the sole surface, the toe surface, and the heel surface.

2. The set of claim 1, wherein the primary element and the at least one secondary element are the same material.

3. The set of claim 2, wherein the first insert comprises a polymeric material.

4. The set of claim 1, wherein a first secondary element is associated with the top surface, a second secondary element is associated with the sole surface, a third secondary element is associated with the toe surface, and a fourth secondary element is associated with the heel surface.

5. The set of claim 1, wherein the base surfaces of each of the first golf club head and the second golf club head are substantially congruent.

6. The set of claim 1, wherein the primary element and the at least one secondary element are different materials.

7. The set of claim 6, wherein the primary element comprises a metallic material and the at least one secondary element comprises a non-metallic material.

8. The set of claim 1, wherein a first secondary element is associated with the sole surface and a second secondary element is associated with the top surface.

9. The set of claim 1, wherein a first secondary element is associated with the toe surface and a second secondary element is associated with the heel surface.

10. The set of claim 1, wherein each of the first golf club head and the second golf club head comprises a second insert associated with the first insert.

11. The set of claim 1, wherein the base surface comprises a first perimetric area and the primary element comprises a second perimetric area, the first perimetric area being greater than the second perimetric area.

12. The set of claim 1, wherein the at least one secondary element is associated with the toe surface and the top surface.

13. A golf club head comprising:

a strike face;

a perimeter-weighting element behind the strike face, the perimeter weighting element including an inner peripheral wall having at least one of a top surface, a sole surface, a heel surface, and a toe surface, the inner peripheral wall delimiting a cavity having a base surface; and a first insert in the cavity, the first insert comprising:

a primary element associated with the base surface; and at least one secondary element associated with at least one of the sole surface, the top surface, the toe surface, and the heel surface; and a passive flexural coupling configured to exert a negligible biasing force between the primary element and the secondary element as the primary and secondary elements are pivoted relative to each other, such that the first primary element is pivotably associated with the at least one secondary element, the flexural coupling comprising a recessed region.

14. The golf club head of claim 13, wherein the primary element is the same material as the at least one secondary element.

15. The golf club head of claim 14, wherein the insert is a polymeric material.

16. The golf club head of claim 13, wherein the primary element and the at least one secondary element are different materials.

17. The golf club head of claim 16, wherein the primary element comprises a metallic material and the at least one secondary element comprises a non-metallic material.

18. The golf club head of claim 13, wherein a first secondary element is associated with the heel surface and a second secondary element is associated with the toe surface.

19. The golf club head of claim 13, wherein a first secondary element is associated with the top surface and a second secondary element is associated with the sole surface.

20. The golf club head of claim 13, wherein a first secondary element is associated with the top surface, a second secondary element is associated with the sole surface, a third secondary element is associated with the toe surface, and a fourth secondary element is associated with the heel surface.

21. The golf club head of claim 13, wherein a second insert is associated with the first insert.

22. The golf club head of claim 21, wherein the second insert is comolded with the first insert.

23. The golf club head of claim 13, wherein the base surface comprises a first perimetric area and the primary element comprises a second perimetric area, the first perimetric area being greater than the second perimetric area.

* * * * *